United States Patent [19]

Crutchfield et al.

[11] Patent Number: 4,609,433

[45] Date of Patent: Sep. 2, 1986

[54] SHEET COMPOSITES CONTAINING CRYSTALLINE PHOSPHATE FIBERS

[75] Inventors: Marvin M. Crutchfield, Creve Coeur; John A. Hinkebein, Ballwin, both of Mo.

[73] Assignee: Monsanto Company, St. Louis, Mo.

[21] Appl. No.: 685,569

[22] Filed: Dec. 24, 1984

[51] Int. Cl.[4] ..... D21H 5/18

[52] U.S. Cl. ..... 162/145; 162/152; 162/164.3; 162/164.6; 162/168.1; 162/169; 162/170; 428/219; 428/288; 428/290; 428/338; 428/379; 428/392; 428/401; 428/704

[58] Field of Search ..... 162/145; 428/288, 290, 428/219, 379, 392, 401, 338, 704

[56] References Cited

U.S. PATENT DOCUMENTS

| | | | |
|---|---|---|---|
| 4,225,383 | 9/1980 | McReynolds | 162/156 |
| 4,346,028 | 8/1982 | Griffith | 523/506 |
| 4,373,992 | 2/1983 | Bondoc | 162/145 |
| 4,387,178 | 6/1983 | Tracy et al. | 524/448 |
| 4,395,306 | 7/1983 | Killat | 162/156 |
| 4,447,560 | 5/1984 | Piersol | 521/68 |

*Primary Examiner*—James C. Cannon

*Attorney, Agent, or Firm*—Wendell W. Brooks; James C. Logomasini; Arnold H. Cole

[57] ABSTRACT

Sheet composites containing asbestiform crystalline calcium M phosphate fibers wherein M is a metal cation selected from the group consisting of sodium and lithium, and mixtures thereof, are useful as a replacement or substitute for asbestos sheets in applications where fibrous materials are needed.

24 Claims, No Drawings

SHEET COMPOSITES CONTAINING CRYSTALLINE PHOSPHATE FIBERS

FIELD OF THE INVENTION

This invention relates to fibrous sheet composites. More particularly, this invention relates to sheet composites containing asbestiform crystalline calcium M phosphate fibers wherein M is a metal cation selected from the group consisting of sodium and lithium, and mixtures thereof. The sheet composites are suitable for use as a replacement or substitute for asbestos sheet composites in applications where fibrous materials are needed. Representative uses of the sheet composites are as muffler paper, underlayment felt for vinyl floor coverings, backing for decorative wall covering, gasket papers, roofing paper, sound-deadening paper, pipe wrap, insulation paper, heat deflection papers, electrically resistant paper, board products, and the like.

DESCRIPTION OF THE PRIOR ART

The use of asbestos in the preparation of fibrous sheets has been practiced for many years. Such fibrous sheets have been used in the preparation of products such as vinyl floor coverings and muffler paper. However, the use of asbestos fibers in such products has recently been considered to represent a long-term health hazard. In some countries, the use of asbestos has been banned and in the United States rather severe restrictions on its use are being contemplated. Accordingly, the search for asbestos-free substitutes—glass wool, rock wool, polyolefin fibers, and cellulose, for example,—has been intensified.

U.S. Pat. No. 4,225,383 discloses a nonwoven fibrous, highly filled sheet containing a water dispersible asbestos-free fiber, a film-forming water-insoluble, organic polymer, and a water insoluble, non-fibrous, inorganic filler, and a method of preparation thereof. The sheets reportedly are characterized by good runnability on common papermaking equipment and excellent strength properties.

In U.S. Pat. No. 4,373,992, a flooring felt is described which reportedly possesses excellent strength properties. The felt contains glass fibers, cellulosic fibers, synthetic organic fibers, particulate inorganic filler, latex binder, and calcium hydroxide.

U.S. Pat. No. 4,395,306 discloses a method for the preparation of reportedly improved nonwoven fibrous mats or sheets from a thickened fibrous suspension of synthetic fibers and an aqueous suspending medium thickened with a synthetic carboxamide polymer. The improvement results from cross-linking the carboxamide polymer by reaction with hypohalite.

Although these prior art sheets and processes are effective to eliminate asbestos in products utilizing such sheets and composites, the commercial utility of nonwoven fibrous composites in applications where fibrous materials are needed is dependent upon such composites' ability to withstand a wide variety of extreme and stressful conditions under use applications, while at the same time, presenting no health hazard. The discovery of the sheet composites of the instant invention, which are able to satisfy such demanding requirements, therefore, is believed to be a decided advance in the asbestos-free fibrous sheet composite art.

SUMMARY OF THE INVENTION

It is an object of this invention to provide novel sheet composites containing asbestiform crystalline calcium M phosphate fibers wherein M is a metal cation selected from the group consisting of sodium and lithium, and mixtures thereof, which are highly effective as a replacement or substitute for asbestos sheet composites in applications where fibrous materials are needed.

To achieve this and other objects which will become apparent from the accompanying description and claims, sheet composites are provided which comprise:

(a) asbestiform crystalline calcium M phosphate fibers wherein M is a metal cation selected from the group consisting of sodium and lithium, and mixtures thereof;

(b) auxiliary fibers; and (c) a water insoluble organic polymeric binder.

DESCRIPTION OF THE PREFERRED EMBODIMENTS

In accordance with this invention, novel sheet composites are provided which are suitable for use as a replacement or substitute for asbestos sheet composites in applications where fibrous materials are needed. These sheet composites comprise:

(a) asbestiform crystalline calcium M phosphate fibers wherein M is a metal cation selected from the group consisting of sodium and lithium, and mixtures thereof;

(b) auxiliary fibers; and (c) a water insoluble organic polymeric binder.

The asbestiform crystalline calcium M phosphate fibers wherein M is a metal cation selected from the group consisting of sodium and lithium, and mixtures thereof, are high molecular weight phosphates $[CaM(PO_3)_3]_n$ wherein n is a number representing the number of repeating $CaM(PO_3)_3$ units. Advantageously, such fibers have an aspect ratio (length-to-average diameter ratio, L/D) of at least 30:1 and an average diameter in the range of from about 0.5 micron (μm) to about 20 μm. Preferred fibers are those having an aspect ratio of from about 40:1 to about 100:1 and an average diameter from about 1 μm to about 10 μm. Among such fibers, particularly preferred are calcium M phosphate fibers wherein M is sodium.

Details of the preparation, crystallinity, and other characterizing properties of asbestiform crystalline calcium M phosphate fibers are described in U.S. Pat. No. 4,346,028, the disclosure of which is herein incorporated by reference.

Auxiliary fibers suitable for use to prepare the sheet composites of the instant invention are those which provide the desired physical properties in the final product and permit processing on papermaking equipment. Such fibers are water insoluble and water dispersible and advantageously are capable of being fibrillated. Included among such fibers are naturally occurring fibers, synthetic fibers, and mixtures thereof. Usually, water dispersibility is provided by a small amount of ionic or hydrophilic groups or charges which are of insufficient magnitude to provide water solubility. Fibers from natural materials—wood pulp, for example—are anionic. Many synthetic fibers, on the other hand, are treated to make them slightly ionic.

The term "synthetic fibers", as employed herein, means auxiliary fibers that are synthesized from simple chemical molecules, and includes inorganic substances extruded in fibrous form and regenerated fibers.

Representative of the naturally-occurring auxiliary fibers suitable for use in the sheet composites of the instant invention are cellulosic (including lignocellulosic) fibers commonly used in the manufacture of felt and paper. Such fibers include those commonly known as wood pulp of the various kinds from hardwood and softwood such as groundwood pulp, steam-heated mechanical pulp, chemimechanical pulp, semichemical pulp, and chemical pulp. Specific examples are unbleached (acid) sulfite pulp, bleached (acid) sulfite pulp, unbleached (alkaline) kraft or sulfate pulp, and bleached (alkaline) kraft or sulfate pulp.

Representative synthetic fibers useful in the practice of the instant invention include glass, rayon, graphite, polyamides (e.g., nylon and aramid), polyesters, polyolefins (e.g., polyethylene and polypropylene), poly(vinyl chloride), and the like.

Suitable auxiliary fibers preferably will have nominal lengths within the range of from about 0.5 millimeters (mm) to about 20 mm, and most preferably from about 1 mm to about 10 mm, and nominal diameters within the range of from about 3 μm to about 20 μm, and most preferably from about 4 μm to about 10 μm.

In the practice of the instant invention, the auxiliary fibers are subjected to mechanical action in the presence of water in a manner variously described in the papermaking art as pulping, beating, or refining. Cellulosic fibers (naturally occurring auxiliary fibers) useful in the practice of this invention preferably are refined to a Canadian Standard Freeness (CSF) at 0.3% consistency (percentage by weight of dry fibrous material) of from about 300 milliliters (ml) to about 700 ml, most preferably from about 400 ml to about 600 ml.

The Canadian Standard Freeness (CSF) value, in ml, is determined according to the Technical Association of the Pulp and Paper Industry (TAPPI) Standard T-227-M-58 on a sample containing 3 g of solids diluted with water to 1000 ml.

Synthetic fibers, in a manner similar to that employed for cellulosic fibers, are mechanically treated to cause fibrillation. Normally, however, such fibers do not provide the same degree of dispersion as is obtained with cellulosic fibers. As a result, the Canadian Standard Freeness test is not particularly adapted to such materials.

Among auxiliary fibers suitable for use in the sheet composites of the instant invention, preferred fibers are cellulosic fibers. Most preferred, as previously noted, are cellulosic fibers refined to a Canadian Standard Freeness of 0.3% consistency of from about 400 ml to about 600 ml.

Water insoluble organic polymeric binder materials useful in the practice of the instant invention are not narrowly critical. Any of the wide variety of natural and synthetic latexes (i.e., aqueous colloidal dispersions) generally known for use in felt and paper manufacture may be used. Conventional styrene-butadiene rubber (SBR) latex is preferred with carboxylated styrene-butadiene rubber (carboxylated SBR) being especially preferred. Other suitable latexes include natural rubber, poly(vinyl acetate), poly(vinyl chloride), polyacrylate, and neoprene latexes. Mixtures of such latexes may also be used.

As will be apparent to those skilled in the paper-making art, the latexes suitable for use as the water insoluble organic polymeric binder in the instant invention may be used either alone or, as discussed hereinbelow, in combination with conventional curatives, antioxidants, and pigments.

The water insoluble organic polymeric binder (i.e., the latex) can be of any conveniently obtainable particle size. Average particle diameters of from about 1000 Angstroms (Å) to about 3000 Å are preferred. Especially preferred are particle diameters from about 1500 Å to about 2500 Å. Since the latex employed in the practice of the instant invention is diluted during the preparation of the sheet composites, the solid content of the latex as supplied is not critical.

In the practice of the instant invention, the phosphate fibers are advantageously treated with a cationic resin prior to admixture with the auxiliary fibers and the water insoluble organic binder in order to ensure compatibility of the nominal ionic charge associated with the phosphate fibers with that of the water insoluble organic binder.

Cationic resins are resins of high cationic character. Included among such resins are two general types of products—polymeric amines and quaternary ammonium polymers. The former group is comprised of polyethylenimines; high Mannich-substituted polyacrylamides; polymers of cationic monomers, especially poly(dimethylamino-ethyl methacrylate); and polyalkylene polyamines. The latter group (quaternary ammonium polymers) includes poly(vinylbenzyltrimethylammonium chloride), poly(diallyldimethylammonium chloride), poly(glycidyltrimethylammonium chloride) and poly(2-hydroxypropyl-1,1-N-dimethylammonium chloride).

Any convenient concentration (on a dry weight basis) of the components of the sheet composites of the instant invention may be used. In general, the sheet composites will comprise from about 60% to about 95% by weight of the phosphate fibers, from about 1% to about 15% by weight of auxiliary fibers, and from about 5% to about 30% by weight of a water insoluble organic polymeric binder. Preferred concentrations, however, for the phosphate fibers will range from about 75% to about 85%, for the auxiliary fibers, from about 3% to about 10%, and for the water insoluble organic polymeric binder, from about 10% to about 20%, all by weight. At such preferred concentrations, the sheet composites, as discussed hereinbelow, exhibit excellent characterizing properties and paper machine runnability. It will be apparent, however, that other concentrations may be employed in the production of the sheet composites of the instant invention, especially those intended for certain specialized end-use applications although, in practice, the stated concentrations are desirable.

The preparation of the sheet composites of the instant invention can be carried out on handsheet-forming apparatus or, preferably, on common, continuous papermaking equipment such as a Fourdrinier machine, a cylinder machine, suction machines such as a Rotaformer, or on millboard equipment. Suitable also for use in preparing the sheet composites of this invention are other well-known modifications of such equipment, for example, a Fourdrinier machine with secondary headboxes or multicylinder machines in which, if desired, different furnishes can be used in the different cylinders to vary the composition and the properties of one or more of the plies which can comprise a finished board.

For further details, reference is made to the general summary of paper and paper making as found in Kirk- Othmer *Encyclopedia of Chemical Technology,* 3rd ed. Vol. 16, John Wiley & Sons, Inc., New York (1981) pages 768–803, with the sheet-forming aspects and appropriate equipment therefor being described on pages 780–792. See also, Shreve & Brink, *Chemical Process Industries,* 4th ed., McGraw-Hill Book Co., New York (1977) pages 555–570.

The term "furnish" is employed herein to mean the mixture of materials blended in the stock suspension from which the sheet composites of the instant invention are made.

In a preferred embodiment, the sheet composites of the instant invention are prepared by forming an aqueous dispersion of asbestiform crystalline calcium sodium phosphate fibers having an aspect ratio of at least 30:1 and an average diameter of from about 0.5 μm to about 20 μm, preferably having an aspect ratio of from about 40:1 to about 100:1 and an average diameter from about 1 μm to about 10 μm. A cationic resin is added to the aqueous dispersion to provide a nominal positive charge to the phosphate fibers in order to ensure compatibility with the latex which normally is anionic. The resulting dispersion is admixed with cellulosic fibers refined to a Canadian Standard Freeness of from about 300 ml to about 700 ml, preferably from about 400 ml to about 600 ml, and a water-insoluble organic polymeric binder. In this preferred embodiment, the aqueous dispersion is formed or prepared to provide a sheet composite containing (on a dry weight basis) from about 65% to about 90%, most preferably from about 70% to about 85%, of phosphate fibers, from about 3% to about 7% of cellulosic fibers (auxiliary fibers), and from about 10% to about 20% of latex (the water-insoluble polymeric binder). Once formed, the aqueous dispersion is distributed and drained on a porous substrate such as a wire to form a wet web or wet sheet composite which is subsequently pressed and dried.

In the mixing of the phosphate fibers and the auxiliary fibers (preferably cellulosic fibers) with other components of the sheet composites, additional water may be added as necessary to reduce the consistency of the resulting furnish to a value suitable for paper making. This value may conveniently range from about 0.1% to about 6%, preferably from about 1% to about 3%. Part of the water of dilution advantageously is white water, or process water, recycled from later steps in the sheet-making process. Alternatively, or additionally, some of the white water can be used as necessary in any required refining step for the auxiliary fibers. After distributing and draining the resulting wet dispersion or furnish, the wet web obtained thereby is wet pressed and, as previously noted, then dried with equipment conventionally used in paper making.

The temperatures employed through the step of forming the wet web usually is in the range from about 20° C. (68° F.) to about 40° C. (104° F.) although temperatures outside the stated range can be employed so long as such temperatures are above the freezing point of the aqueous dispersion and are below the temperature at which the latex polymer being employed would soften unduly. Temperatures above ambient conditions may at times be advantageously employed to promote faster drainage.

In many instances, it may be desirable to modify the properties of the sheet composites. To accomplish such modification(s), small amounts of various wet end additives of the types commonly employed in paper-making may be incorporated into the sheet composites by adding such additives to the aqueous dispersion. Such materials include antioxidants; sizings; various hydrocarbons and natural waxes, particularly in the form of anionic or cationic emulsions; particulate inorganic, essentially water-insoluble fillers having a particle diameter less than 50 μm such as titanium dioxide, amorphous silica, zinc oxide, barium sulfate, calcium carbonate, calcium sulfate, aluminum silicate, clay, magnesium silicate, diatomaceous earth, aluminum hydroxide, magnesium carbonate, partially calcined dolomitic limestone, magnesium hydroxide, and mixtures thereof; cellulose derivatives such as carboxymethyl cellulose and carboxyethyl cellulose; water soluble organic dye stuffs, water-insoluble but water dispersible coloring pigments such as carbon black, vat colors, and sulfur colors; strength improving resins such as melamine-formaldehyde resins, urea-formaldehyde resins, aminopolyamide-epichlorohydrin resins, and polymeric amine-epichlorohydrin resins; and curing agents of various types such as sulfur-containing vulcanizing agents and accessory compounds. In addition, ionic surfactants, preferably anionic, may be added in small amounts. Nonionic surfactants, however, are generally not useful in the sheet composites of the instant invention.

The thickness of the sheet composites of the instant invention can vary from about $7.62\times10^{-3}$ cm (3 mils) to about $3.175\times10^{-1}$ cm (125 mils), the preferred value depending upon the proposed use of the sheet composites. In general, however, the thickness will range from about $3.81\times10^{-2}$ cm (15 mils) to about $1.65\times10^{-1}$ cm (65 mils).

The sheet composites of the instant invention possess excellent strength properties, smooth surface characteristics, dimensional stability, resistance to microbiological growth, resistance to moisture effects, and paper machine runnability. In addition, the sheet composites are processable into sheet vinyl flooring in a conventional manner.

The following specific examples illustrating the best presently-known methods of practicing this invention are described in detail in order to facilitate a clear understanding of the invention. It should be understood, however, that the detailed expositions of the application of the invention, while indicating preferred embodiments, are given by way of illustration only and are not to be construed as limiting the invention since various changes and modifications within the spirit of the invention will become apparent to those skilled in the art from this detailed description.

EXAMPLE 1

(a) Calcium Sodium Phosphate Fibers

Asbestiform crystalline calcium sodium phosphate fibers were prepared in five batches of 29.0 kg to 70.3 kg (64 to 155 lb) each by scale-up of the general procedures described in the previously referenced U.S. Pat. No. 4,346,028. In a typical preparation, 20.452 parts 85.2% phosphoric acid, 4.880 parts calcium carbonate, 3.241 parts sodium carbonate and about 8.1 parts distilled water, providing an anhydrous basis mole percent ratio of 50.60% $P_2O_5$, 32.45% CaO, and 16.95% $Na_2O$, were placed in a large alumina crucible and heated slowly in a furnace at a rate of 5° C./hr up to 1000° C., at which point essentially all the water and $CO_2$ had been driven off and the contents were molten. The melt was held at 1000° C. for 24 hr, cooled to 740° C., at which time several small seed crystals of $[CaNa(PO_3)_3]_n$ were added to the surface of the melt which was held at 740° C. for 72 hr to crystallize. The temperature was reduced to 720° C. and held for an additional 72 hr to complete the crystallization, after which the crystallized mass was slowly cooled to room temperature and removed from the crucible. The crystallized mass was broken apart, passed through a mechanical jaw crusher, and then fiberized by dry milling in an air classification mill. Fibers from several different batches were combined to provide a composite sample of $2.27\times10^2$ kg (500 lb) of fibers for testing. The fibers had an average aspect ratio of 64.5, an average diameter of 2.09 μm, and a surface area of 6773 $cm^2/g$.

(b) Sheet Composite Preparation

The phosphate fiber sheet composites were prepared by use of a Four-dinier Paper Machine having (a) a 91.44-centimeter (36-inch) wide plastic wire, (b) a headbox equipped with a manifold type inlet, homogenizer and distributor rolls, and a Neilson slice, (c) a suction couch roll, (d) a straight-through plain press, and a plain reversing press, the rolls being cast iron with rubber and stonite covers, (e) a dryer section consisting of 7 and 5 driers with integrally cast journals and 2 felt driers on the bottom and top first section felts and (f) a calendar stack consisting of eight rolls with the intermediate rolls bored for steam. The machine was also equipped with a 91.44-cm (36-inch) diameter Pope type reel with a 91.44-cm face capable of winding rolls up to 101.6 cm (40 inches) in diameter.

To a machine chest (Semtile Stock Chest) having a capacity of $1.14\times10^4$ liters (3000 U.S. liquid gallons) and containing $3.79\times10^3$ l (1000 gal) of water at ambient temperature was charged, with agitation, $2.27\times10^2$ kg (500 lb) of calcium sodium phosphate fibers prepared as described in Section (a) above. The resulting slurry was diluted with additional water [approximately $7.10\times10^3$ l (1900 gal)] to provide a total volume of approximately $1.10\times10^4$ l (2900 gal). To this aqueous slurry was charged in series 13.1 kg [28.8 lb, 33.7 l (8.9 gal)] of a wet strength paper additive (a cationic thermosetting polyamine-epichlorohydrin resin sold commercially as Santo-Res ® CM by Monsanto Company), 56.7 kg [125 lb, $1.14\times10^2$ l (30 gal)] of an aqueous dispersion of a carboxylated styrene-butadiene rubber latex [in admixture with 3 percent of polymeric hindered phenol-thioester blend antioxidant (available commercially from Textile Rubber & Chemical Co. as T-414)] having 46 percent solids and an average particle diameter of 1900 Å (available commercially from Dow Chemical Company as XD-30192.00), and 10.0 kg (22 lb) of common bleached softwood kraft refined to a Canadian Standard Freeness of 485 ml.

The resulting furnish or aqueous dispersion was pumped from the machine chest through a flow controller valve to the suction of a fan pump where the thick furnish was diluted with white water from the wire to the required paper-making consistency. (A consistency of about 1% to about 2.5% was employed although higher consistencies, for example, about 4% to about 6% may be employed, if desired.) The diluted furnish was pumped from the fan pump to the headbox of the Fourdrinier Machine through a five-pipe manifold inlet. The furnish from the headbox was fed onto the wire moving at 12.7 cm/sec (25 ft/min) where white water drained to form a wet sheet from which additional water was removed by means of the suction boxes before the sheet was removed from the wire at the suction couch roll. After the two press stages had reduced the water content still further, the sheet was fed through the dryer and calendar stack and collected as rolls. The rolls were slit and trimmed to yield three rolls of phosphate fiber sheet composite—1 roll, 38.1 cm wide×83.8 m long (15 in wide×275 ft long); 1 roll, 38.1 cm wide×53.3 m long (15 in wide ×175 ft long); and 1 roll, 33.02 cm wide×83.8 cm long (13 in wide×275 ft long, all having a nominal thickness of $7.62\times10^{-2}$ cm (30 mils). Property data for the sheet composites are tabulated in Table 1.

TABLE 1

| | |
|---|---|
| COMPOSITION, wt % | |
| Phosphate Fibers | 73.6 |
| Carboxylated SBR Latex | 18.4 |
| Santo-Res ® CM | 4.2 |
| Bleached Softwood Kraft | 3.8 |
| PROPERTIES | |
| Basis wt, kg/278.7 $m^2$ (lb/3000 $ft^2$) | |
| $1.31\times10^2$ (288) | |
| Apparent Density, $kg/m^3$ ($lb/ft^3$) | |
| $5.96\times10^2$ (37.2) | |
| Tensile,[1] kN/m (lb/in) | |
| Ambient[2] | |
| Machine | 5.3 (30.3) |
| Cross | 4.1 (23.3) |
| Hot[3] (190.6° C.) | |
| Machine | 1.6 (9.2) |
| Cross | 1.2 (7.0) |
| Elmendorf Tear,[4] g | |
| Machine | 195 |
| Cross | 200 |
| Sheffield Smoothness,[5] ml | |
| Felt Side | 359 |
| Wire Side | 398 |

[1]Sheets are cut into 2.54 cm × 20.32 cm (1 in × 8 in) strips. The strip being tested is placed in an Instrom test machine having a 15.24 cm (6 in) test span. While the Instrom is operated at a cross head speed of 0.042 cm/sec (1 in/min), the elongation and Newtons (pounds) at break are recorded.
[2]The ambient tensile is tested in the manner described in Footnote 1 on test specimens held at ambient temperatures.
[3]The hot tensile is tested in the manner described in Footnote 1 except that just before the test, the test specimen is heated over a period less than one minute duration to a temperature of 190.6° C. (375° F.) while clamped in the jaws of the test machine, at which time the tensile pull is applied.
[4]The test is carried out according to TAPPI method T414-ts-65. Results are shown as an average of at least three samples.
[5]The test is carried out according to TAPPI useful method UM-518.

Thus, it is apparent that there has been provided in accordance with the instant invention, sheet composites containing crystalline phosphate fibers that fully satisfy the objects and advantages set forth hereinabove. While the invention has been described with respect to various specific examples and embodiments thereof, it is understood that the invention is not limited thereto and that many alternatives, modifications, and variations will be apparent to those skilled in the art in light of the foregoing description. Accordingly, it is intended to embrace all such alternatives, modifications, and variations as fall within the spirit and broad scope of the invention.

What is claimed is:

1. A sheet composite containing crystalline phosphate fibers comprising:

(a) as the major fiber component, asbestiform crystalline calcium M phosphate fibers wherein M is a metal cation selected from the group consisting of sodium and lithium, and mixtures thereof;

(b) as the minor fiber component, auxiliary fibers selected from the group consisting of cellulosic fibers, glass fibers, rayon fibers, graphite fibers, polyamide fibers, polyester fibers, polyolefin fibers, and poly(vinyl chloride) fibers; and (c) a water insoluble organic polymeric binder.

2. The sheet composite of claim 1 wherein M is sodium.

3. The sheet composite of claim 1 wherein the phosphate fibers have an aspect ratio of at least 30.1.

4. The sheet composite of claim 1 wherein the phosphate fibers have an aspect ratio of from about 40:1 to about 100:1.

5. The sheet composite of claim 1 wherein the phosphate fibers have an average diameter of from about 0.5 μm to about 20 μm.

6. The sheet composite of claim 5 wherein the phosphate fibers have an average diameter of from about 1 μm to about 10 μm.

7. The sheet composite of claim 1 wherein the auxiliary fibers are cellulosic fibers.

8. The sheet composite of claim 7 wherein the cellulosic fibers are bleached softwood kraft.

9. The sheet composite of claim 7 wherein the cellulosic fibers are refined to a Canadian Standard Freeness of from about 300 ml to about 700 ml.

10. The sheet composite of claim 9 wherein the cellulosic fibers are refined to a Canadian Standard Freeness of from about 400 ml to about 600 ml.

11. The sheet composite of claim 1 wherein the water insoluble organic polymeric binder is a latex.

12. The sheet composite of claim 11 wherein the latex is selected from the group consisting of styrene-butadiene rubber, carboxylated styrene-butadiene rubber, natural rubber, poly(vinyl acetate), poly(vinyl chloride), polyacrylate, and neoprene.

13. The sheet composite of claim 12 wherein the latex is carboxylated styrene-butadiene rubber.

14. The sheet composite of claim 11 wherein the latex is an anionic latex.

15. The sheet composite of claim 1 wherein the water insolube organic binder has an average particle diameter of from about 1000 Å to about 3000 Å.

16. The sheet composite of claim 1 wherein the water insoluble organic binder has an average particle diameter of from about 1500 Å to about 2500 Å.

17. The sheet composite of claim 1 which further comprises an added cationic resin.

18. The sheet composite of claim 17 wherein the cationic resin is a thermosetting polyamine-epichlorohydrin resin.

19. The sheet composite of claim 1 which further comprise wet end additives.

20. The sheet composite of claim 19 wherein the wet end additives comprises an antioxidant.

21. The sheet composite of claim 20 wherein the antioxidant is a polymeric hindered phenolthioester blend.

22. The sheet composite of claim 1 wherein the sheet composite comprises on a dry basis:

(a) from about 60% to about 95% by weight of phosphate fibers;

(b) from about 1% to about 15% by weight of auxiliary fibers; and (c) from about 5% to about 30% by weight of at least one water insoluble organic polymeric binder.

23. A sheet composite containing crystalline phosphate fibers comprising on a dry weight basis:

(a) from about 70% to about 85% of asbestiform crystalline calcium sodium phosphate having an aspect ratio of from about 40:1 to about 100:1 and an average diameter of from about 1 micron to about 10 microns.

(b) from about 3% to about 7% of cellulosic fibers; and (c) from about 10% to about 20% of carboxylated styrene-butadiene rubber.

24. The sheet composite of claim 23 wherein the sheet composite is characterized by:

(a) a basis weight of at least $1.31\times10^2$ kg/278.7 $m^2$;

(b) an apparent density of at least $5.96\times10^2$ kg/$m^3$;

(c) an ambient tensile strength in the machine direction of at least 5.3 kN/m and in the cross direction of at least 4.1 kN/m;

(d) a hot tensile strength in the machine direction of at least 1.6 kN/m and in the cross direction of at least 1.2 kN/m;

(e) an Elmendorf Tear in the machine direction of at least 195 g and in the cross direction of at least 200 g; and (f) a Sheffield Smoothness of less than 400 ml each on the felt side and on the wire side.

* * * * *